US008215502B1

(12) United States Patent
Beavers

(10) Patent No.: US 8,215,502 B1
(45) Date of Patent: Jul. 10, 2012

(54) ELECTRICALLY CONDUCTIVE ATTACHMENT SYSTEM AND RACK

(75) Inventor: Tom Beavers, Circleville, OH (US)

(73) Assignee: Production Plus Corporation, Columbus, OH (US)

( * ) Notice: Subject to any disclaimer, the term of this patent is extended or adjusted under 35 U.S.C. 154(b) by 356 days.

(21) Appl. No.: 12/567,121

(22) Filed: Sep. 25, 2009

(51) Int. Cl.
*A47F 5/08* (2006.01)

(52) U.S. Cl. ..... 211/119

(58) Field of Classification Search ..... 211/119, 211/113, 118, 89.01, 124, 181.1, 106.01; 204/297.01, 297.06, 297.09, 297.1, 297.14; 248/302, 215; 118/500, 620, 622, 503; 174/68.1, 174/69.3, 72 A, 72 C, 70 C, 95, 72 R; 24/458, 24/369, 601.3; 269/903; 254/134.3 CL, 254/134.3 PA See application file for complete search history.

(56) References Cited

U.S. PATENT DOCUMENTS

| | | | | | |
|---|---|---|---|---|---|
| 1,750,807 | A | * | 3/1930 | Lichtman | 204/297.1 |
| 2,258,391 | A | * | 10/1941 | Novitsky | 204/297.1 |
| 2,512,554 | A | * | 6/1950 | Schneider | 204/297.09 |
| 2,734,859 | A | | 2/1956 | Reilly et al. | |
| 2,858,266 | A | | 10/1958 | Schneider | |
| 3,029,952 | A | | 4/1962 | Bagdon et al. | |
| 3,429,786 | A | * | 2/1969 | Kubik | 205/125 |
| 3,642,147 | A | * | 2/1972 | Voorhies | 211/57.1 |
| 3,785,952 | A | * | 1/1974 | Ritzenhoff | 204/297.1 |
| 4,037,727 | A | | 7/1977 | Kunkle | |
| 4,097,359 | A | | 6/1978 | Davitz | |
| 4,217,853 | A | * | 8/1980 | Davitz | 118/500 |
| 4,243,146 | A | * | 1/1981 | Davitz | 211/118 |
| 4,628,859 | A | * | 12/1986 | Hines | 118/630 |
| 4,679,526 | A | * | 7/1987 | Dziedzic | 118/503 |
| 4,872,963 | A | * | 10/1989 | Van Horn | 204/297.09 |
| 4,899,966 | A | * | 2/1990 | Antos et al. | 248/74.4 |
| 5,020,677 | A | * | 6/1991 | Wirth et al. | 211/113 |
| 5,084,155 | A | * | 1/1992 | Engwall | 204/297.1 |
| 5,088,609 | A | * | 2/1992 | Fryc | 211/117 |
| 5,147,050 | A | * | 9/1992 | Cullen | 211/118 |
| 5,524,774 | A | * | 6/1996 | Cullen | 211/113 |
| 5,607,069 | A | | 3/1997 | Stroobants et al. | |
| 5,762,205 | A | | 6/1998 | Davitz | |
| 5,788,829 | A | * | 8/1998 | Joshi et al. | 205/96 |
| 5,908,120 | A | * | 6/1999 | Yates et al. | 211/119 |
| 6,189,709 | B1 | * | 2/2001 | Cullen | 211/118 |
| 6,607,600 | B2 | | 8/2003 | DeWent | |
| 7,021,476 | B2 | * | 4/2006 | Lloyd et al. | 211/113 |

* cited by examiner

*Primary Examiner* — Jennifer E. Novosad
(74) *Attorney, Agent, or Firm* — Hahn, Loeser & Parks LLP; Rex W. Miller, II

(57) ABSTRACT

An electrically conductive attachment system is disclosed. The attachment system may have a tubular portion of electrically conductive material adapted to be attached to a support beam, and a mounting clip adapted to be attached to a cross-bar and to releaseably engage the tubular portion. The mounting clip may have an attachment portion adapted to be attached to a cross-bar and to releaseably engage the tubular portion having an attachment portion adapted to electrically connect the mounting clip to the cross-bar, and an engagement portion adapted to be inserted through a top opening of the tubular portion engaging an inner surface of the tubular portion and providing an electrical connection between the tubular portion and the mounting clip. The attachment system may be capable of releaseably connecting the cross-bar substantially transverse the support beam and providing an electrical connection therebetween.

20 Claims, 5 Drawing Sheets

ELECTRICALLY CONDUCTIVE ATTACHMENT SYSTEM AND RACK

BACKGROUND AND SUMMARY

The present disclosure is related to electrically conductive attachment devices and racks for supporting articles to be coated.

Racks for supporting articles or workpieces to be coated are common to many finishing systems. In the past, such support racks have usually included several vertically stacked, horizontal rows or tiers of protruding, article engaging hooks upon which workers would hang workpieces for surface coating. A variety of coating techniques have been commonly employed such as spray coating, dip coating, and plating. These coating techniques often require the articles to be electrically charged or grounded to attract oppositely charged particles of a coating or plating material causing the material to adhere to the surface of the articles. These coating techniques are also commonly referred to as electro-static, electro-deposition, or electro-plating.

The article engaging hooks used with article support racks are often connected to vertically spaced, horizontal cross-bars. The cross-bars are in turn connected at their opposite ends to vertical side bars. The side bars bear the weight of the cross-bars and in the articles to be coated.

Many industrial finishing systems include a conveyor from which one or more article support racks are suspended. Typically, the conveyor provides an electrical connection and the electrical conductivity through the support rack to the article engaging hooks enables the articles to be electrically charged or electrically grounded as required by the finishing system. The conveyors have also provided for the transportation of support racks through the finishing system.

In many applications, a large number of workpieces, such as component parts, are mounted on the hooks for transportation through a finishing system. Many finishing systems have a series of stations at which the workpieces may be sequentially treated by applying one or more materials for cleaning, rinsing, surface preparation, drying, coating, curing or baking the workpieces. For example, in electro-static systems, liquid or solid charged particles have been sprayed onto the workpieces at a coating station such as a spray booth. In order for the charged particles to be attracted to the workpieces, a conductive path from the conveyor through the support rack to the workpiece is required. Similarly, in electro-deposition systems, liquid or solid particles of coating material may be suspended in a solution and the workpieces on a support rack may be dipped into a vat of this solution at a different coating station. Many plating operations operate in a similar manner.

The finishing systems are typically designed to finish or coat a large number of identical parts. Often, the finishing systems have been used for only one size part at a time, processing all parts of one size and then coating parts of a different size. One obstacle to efficient operation of finishing systems has been that workpieces come in different sizes and with different support requirements. In the past, it has been necessary to utilize a different support rack for each job or to disassemble and reassemble the support racks into different configurations when transitioning between different size workpieces. The productivity of a finishing system is determined, in part, by the number of workpieces that may be coated at one time, therefore support racks have often been customized to specific size parts. As each support rack was tailored to a specific size or type of part, multiple support racks were required significantly increasing the cost and space requirements of the finishing system.

To overcome the inefficiencies of using different sets of permanently configured support racks, racks that may be disassembled and reconfigured have been desired. If such racks can be reconfigured without excessive time or labor costs and will operate properly once reconfigured, the efficiency and productivity of a finishing system may be improved. Such racks permit many diverse and different parts to be finished, yet require an investment in only one set of racks.

Various reconfigurable support racks have been proposed. However, the development of a single, reconfigurable set of racks has posed several problems resulting from the fact that finishing or coating material often adheres not only on the workpieces, but also on the portions of the support rack exposed during the finishing process. Paint or other coating material ordinarily has a high electrical resistance. Consequently, when a support rack that has been coated with a coating material during previous finishing operations is disassembled and reassembled, the coating material often prevents or degrades electrical contact between the component parts of the rack. This problem is especially difficult in dip coating or electro-deposition coating systems because when the support rack is immersed in a coating material all surfaces of the support rack are susceptible to the accumulation of undesired coating material. Additionally, techniques, such as shields or covers, adapted for preventing spray coatings from accumulating have sometimes created pockets in which coating material accumulates during dip coating further interfering with the reconfiguration of the support racks.

When prior support racks have become coated with excess coating material, one solution has been to chemically clean or strip the coating material from the support rack. These cleaning or stripping operations often require removing the support rack from the finishing system decreasing the productivity of the finishing system and increasing costs. Another problem with some previously proposed adjustable support racks is the limited range of adjustment or interchangeability of the support rack components. For example, some prior support racks (see, e.g., U.S. Pat. No. 4,872,963) provided custom cross-bars adapted for use with a single rack. Another frequently encountered problem with previous designs has been that accumulated coating material often mechanically bonds the component parts of a support rack, can hinder the disassembly, and can mechanically interfere with reassembly of the support rack in a different configuration.

In light of the limitations of the previously available systems, therefore, there continues to be a need for article support racks and attachment systems capable of being reconfigured while maintaining an electrical connection to the articles and reducing the time and cost of disassembling and reassembling the support rack to accommodate articles of different size or configurations.

An electrically conductive attachment system is disclosed comprising (a) a tubular portion of electrically conductive material adapted to be attached to a support beam having (i) a top opening and a bottom opening, and (ii) an inner surface extending substantially between the top opening and the bottom opening; and (b) a mounting clip adapted to be attached to a cross-bar and to releaseably engage the tubular portion having (i) an attachment portion adapted to electrically connect the mounting clip to the cross-bar, and (ii) an engagement portion adapted to be inserted through the top opening of the tubular portion engaging the inner surface of the tubular portion and providing an electrical connection between the tubular portion and the mounting clip; and (c) the attachment system capable of releaseably connecting the cross-bar substantially transverse the support beam and providing an electrical connection therebetween.

Also disclosed is the tubular portion having a substantially circular cross-section or a substantially rectangular cross section. The tubular portion may have a non-circular cross-section including at least two corners. The engagement portion may be adapted to engage the inner surface of the tubular portion substantially adjacent at least two corners of the tubular portion or substantially adjacent four corners of the tubular section. In one example, the tubular portion may comprise steel square tube.

Also disclosed is that the attachment portion of the mounting clip may comprise a torsion spring, a resilient wire, or a resilient wire extending around the cross-bar. The engagement portion of the mounting clip may comprise a resilient wire forming a substantially J-shaped hook adapted to resiliently engage the inner surface of the tubular portion. The engagement portion may be further adapted to abrade the inner surface of the tubular portion during insertion of the engagement portion into the tubular portion.

An electrically conductive article support rack is also disclosed comprising (a) a hanger portion; (b) two support beams electrically connected to the hanger portion adapted to support at least one cross-bar transverse the support beams; (c) the at least one cross-bar adapted to support articles in electrical connection with the support rack, the cross-bar being attached to the support beams by attachment devices; (d) the attachment devices each comprising (1) a tubular portion of electrically conductive material adapted to be attached to a support beam having (i) a top opening and a bottom opening, and (ii) an inner surface extending substantially between the top opening and the bottom opening; and (2) a mounting clip adapted to be attached to a cross-bar and to releaseably engage the tubular portion having: (i) an attachment portion adapted to electrically connect the mounting clip to the cross-bar; and (ii) an engagement portion adapted to be inserted through the top opening of the tubular portion engaging the inner surface of the tubular portion and providing an electrical connection between the tubular portion and the mounting clip; and (3) the attachment devices capable of releaseably connecting the cross-bar substantially transverse the support beams and providing an electrical connection therebetween.

An alternative electrically conductive article support rack is also disclosed comprising (a) a hanger portion; (b) two vertical support beams electrically connected to the hanger portion adapted to support at least one cross-bar transverse the vertical support beams, (c) the at least one cross-bar adapted to support articles in electrical connection with the support rack, the cross-bar being attached to the vertical support beams by attachment devices, (d) the attachment devices each comprising (1) a tubular portion of electrically conductive material adapted to be attached to a support beam having (i) a top opening and a bottom opening; (ii) an inner surface extending substantially between the top opening and the bottom opening; and (iii) a non-circular cross section including at least two corners; and (2) a mounting clip adapted to be attached to a cross-bar and to releaseably engage the tubular portion having (i) a torsion spring attaching the mounting clip to a cross-bar; and (ii) a wire-form engagement spring adapted to be inserted through the top opening of the tubular portion resiliently engaging the tubular portion substantially adjacent opposite corners of the tubular portion and providing an electrical connection between the mounting clip and the tubular portion; and (3) the attachment device capable of releaseably connecting the cross-bar substantially transverse to the vertical support beams and capable of providing an electrical connection therebetween.

Also disclosed is a cross-bar comprising end portions connected to opposite ends of a center portion, where the end portions are adapted to receive the torsion spring of the mounting clip. The end portions of the cross-bar may comprise stainless steel rod.

DETAILED DESCRIPTION OF THE DRAWINGS

Figure 1:
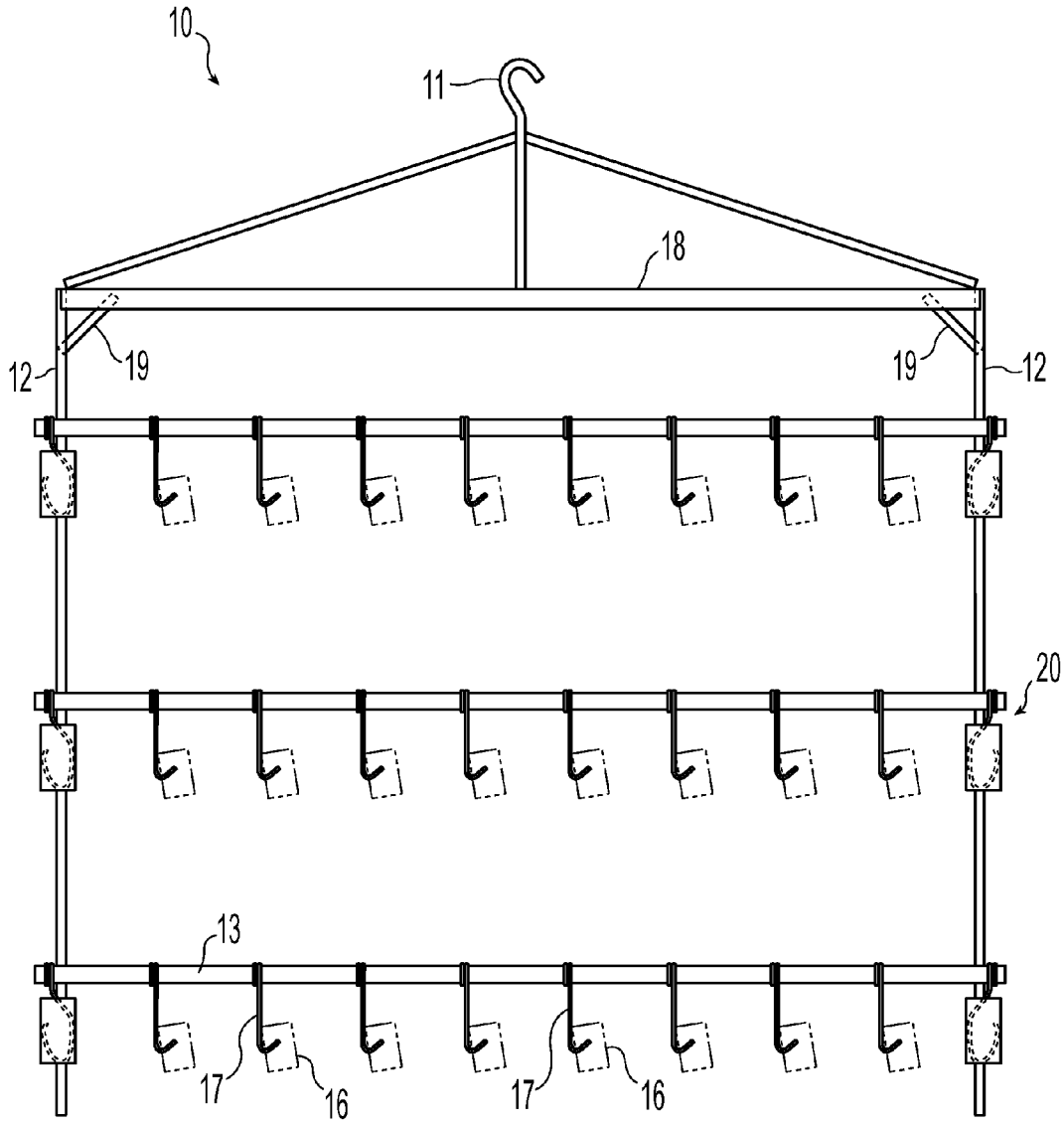
FIG. 1 is a front view of an electrically conductive article support rack.

Referring generally to FIGS. 1-6, an electrically conductive attachment system is disclosed. The electrically conductive attachment system may be used in an electrically conductive article support rack 10, as shown in FIG. 1. The electrically conductive article support rack 10 may comprise a hanger portion 11, an upper support member 18, and two support beams 12 electrically connected to the hanger portion 11 and adapted to support at least one cross-bar 13 transverse the support beams. In other embodiments (not shown), the electrically conductive support rack 10 may include two or more hanger portions. In yet other embodiments, the hanger portions may be integrated with the support beams 12 for attachment to a conveyor or other support structure. Optionally, the support rack 10 may also have auxiliary support members 19 between the support beams 12 and the upper support member 18. Such auxiliary support member 19 may be desired to provide rigidity for larger rack configurations. The at least one cross-bar 13 may be adapted to support articles 16 in electrical connection with the support rack 10. The cross-bar 13 may be attached to the support beams 12 by electrically conductive attachment devices 20.

The electrically conductive article support rack 10 may be used as part of an overall coating system including a conveyor (not shown) or similar device to which the hanger portion 11 may attach. The coating system may provide an electrical ground such that through the hanger portion 11 the electrically conductive article support rack 10 may be grounded. Electrical connectivity between the hanger portion 11, the support beams 12, the cross-bars 13, and the article hooks 17 may also ground the articles 16 to be coated in the coating system. In a spray coating or electro-static coating system, a coating material, such as paint, may be electrically charged and sprayed towards the articles 16 supported by the article hooks 17. The electrically charged coating material may thus be electrically attracted to the electrically grounded articles 16 facilitating the coating of the articles. Similarly in a dip coating or electro-deposition system, a vat may contain electrically charged coating material suspended in a solution, and the charged coating material may be attracted to the electrically grounded articles 16 when the rack 10 is dipped or submerged into the vat. In both spray coating and dip coating operations, maintaining electrical connectivity through the components of the support rack 10 to the articles 16 is therefore desired to achieve proper coating of the articles.

Figure 2A:
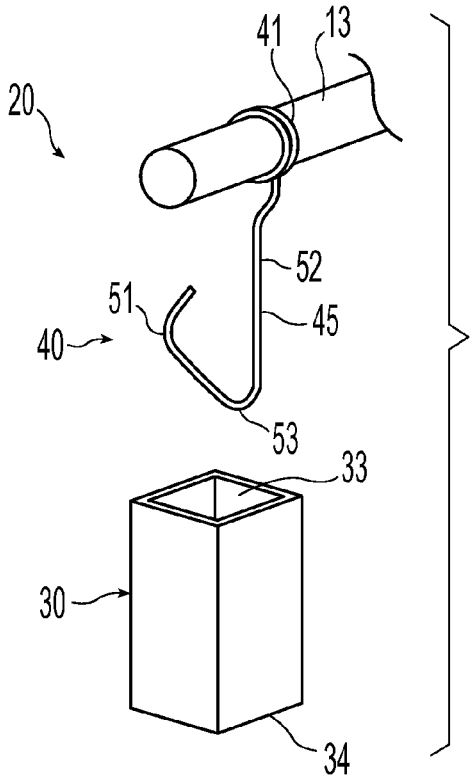
FIGS. 2A-B are perspective views of an electrically conductive attachment device.

The electrically conductive attachment device 20 may comprise a tubular portion 30 and a mounting clip 40, as illustrated in FIG. 2A. The attachment device 20 may be capable of releaseably connecting a cross-bar 13 substantially transverse a support beam 12 and providing an electrical connection between the cross-bar 13 and the support beam 12.

Figure 3A:
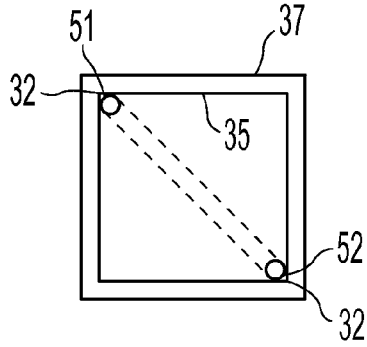
FIGS. 3A-B are cross-section views of the attachment device of FIG. 2.
Figure 7:
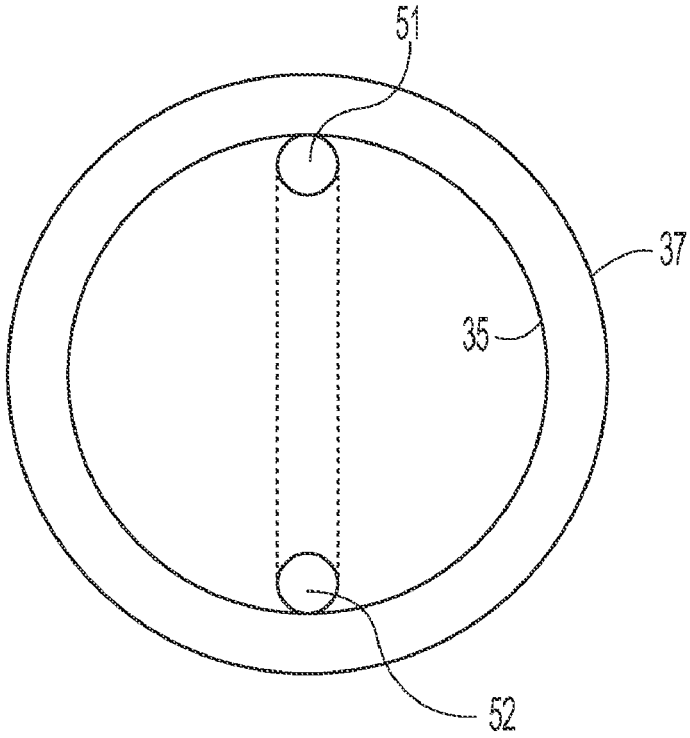
FIG. 7 is a cross-section view of an attachment device in which the tubular portion has a circular cross-section.

The tubular portion 30 of the attachment device 20 may be an electrically conductive material adapted to be attached to a support beam 12. The tubular portion 30 comprises a top opening 33 and a bottom opening 34. A top opening 33 and a bottom opening 34 may be preferred when the electrically conductive attachment system is used in dip coating operations so that excess coating material may drain out of the tubular portion 30. Referring to FIG. 3A, the tubular portion 30 may have an inner surface 35 and an outer surface 37 extending substantially between the top opening 33 and the bottom opening. The inner surface 35 and the outer surface 37 of the tubular portion 30 form walls of the tubular portion extending between the top and bottom openings. The tubular portion 30 may have a substantially circular cross-section, such as shown in FIG. 7. Alternatively, the tubular portion 30 may have a non-circular cross-section including at least two corners, such as a substantially rectangular cross-section. In one example, the tubular portion 30 may comprise steel square tube, and the cross-section may be substantially square. In another example, the tubular portion 30 may comprise copper.

Figure 4A:
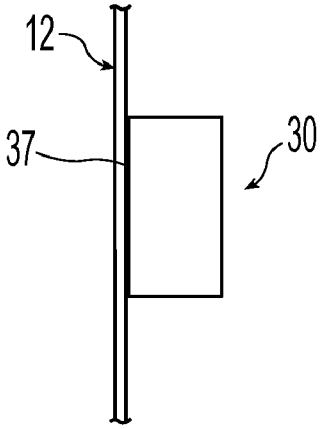
FIGS. 4A-B are side views of attachments of the tubular portion to a support beam.

The tubular portion 30 may be attached to the support beam 12 so as to achieve an electrical connection. For example, the tubular portion 30 may be welded to the support beam 12 such that the outer surface 37 of the tubular portion establishes an electrical connection with the support beam 12 as illustrated in FIG. 4A. Alternatively, the tubular portion 30 may be attached by a clamp (not shown) or similar device securing the outer surface 37 of the tubular portion 30 in contact with the support beam 12.

Figure 4B:
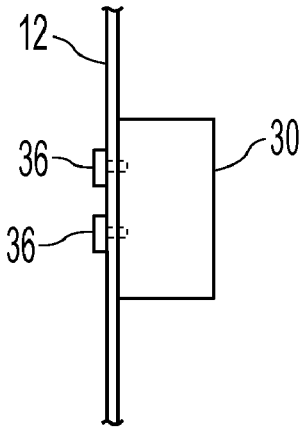

In another example, the tubular portion 30 may be attached to the support beam by screws 36, as shown in FIG. 4B. In this example, the screws 36 may pass through the support beam 12 and into the wall of the tubular portion 30 establishing an electrical connection. The screws 36 or other similar mechanical attachments may be desired if the outer surface 37 of the tubular portion 30 is covered by a coating, such as a protective coating, that would prevent direct contact of the outer surface with the support beam.

The mounting clip 40 of the attachment device 20 may be adapted to be attached to a cross-bar 13 and to releaseably engage the tubular portion 30. The mounting clip 40 may be formed of various conductive materials and in various configurations as more fully explained below. The mounting clip 40 comprises an attachment portion 41 adapted to electrically connect the mounting clip to the cross-bar 13. The attachment portion 41 of the mounting clip 40 also secures the mounting clip to the cross-bar 13. The mounting clip 40 also comprises an engagement portion 45 adapted to be inserted through the top opening 33 of the tubular portion 30 engaging the inner surface 35 of the tubular portion and providing an electrical connection between the tubular portion and the mounting clip.

The mounting clip 40 may be attached near the ends of the cross-bar 13 to engage tubular portions 30 attached to support beams 12. The distance between the tubular portions 30 may determine the placement of the mounting clips 40 on the cross-bar 13. Additionally, the mounting clip 40 may be moved or relocated on the cross-bar 13 to permit the cross-bar 13 to be used with different support racks. In some applications, it may be desired to use a given cross-bar 13 with support racks having different dimensions between the support beams 12. The ability to position or reposition the mounting clip 40 along the length of the cross-bar 13 may permit a cross-bar 13 to be used with multiple support racks increasing the flexibility of a coating operation and reducing costs. Alternatively, routine repair and replacement of support rack components combined with overall wear of the support rack may cause the distance between tubular portions 30 to vary slightly and the ability to reposition the mounting clip 40 may permit the cross-bars 13 to be adjusted to accommodate such variations extending the useful life of the system.

The mounting clip 40 may be formed from resilient wire. In one example, the mounting clip 40 may be formed from wire having a 0.090 inch diameter, or from wire having a larger or smaller diameter as desired. The attachment portion 41 of the mounting clip 40 may comprise a resilient wire extending around the cross-bar 13. The resilient wire may be formed into one or more loops extending around the cross-bar 13 to secure the mounting clip 40 to the cross-bar. For example, the resilient wire may form a helical spring. In one embodiment, the attachment portion 41 may comprise a torsion spring 42. The torsion spring 42 may be formed with a diameter slightly smaller than the diameter of the cross-bar 13. To attach the torsion spring 42 to the cross-bar 13, the torsion spring may be opened or expanded to allow the torsion spring to pass over the end of the cross-bar. The torsion spring 42 may then close or contract around the cross-bar 13 to secure the mounting clip 40 to the cross-bar and provide an electrical connection. Tension in the torsion spring 42 may be sufficient to secure the mounting clip to the cross-bar 13 without the need for welding or other mechanical attachment such as screws or bolts. A mounting clip 40 secured by a torsion spring 42 may be more durable and decrease repair costs by limiting premature breakage of the mounting clip. By improving reliability of the mounting clip 40, the reliability of the electrically conductive support rack 10 may be improved and overall costs reduced. However, in some embodiments, it may be desired to spot weld a portion of the torsion spring 42 to the cross-bar 13 to limit potential movement of the attachment portion 41.

Figure 5A:
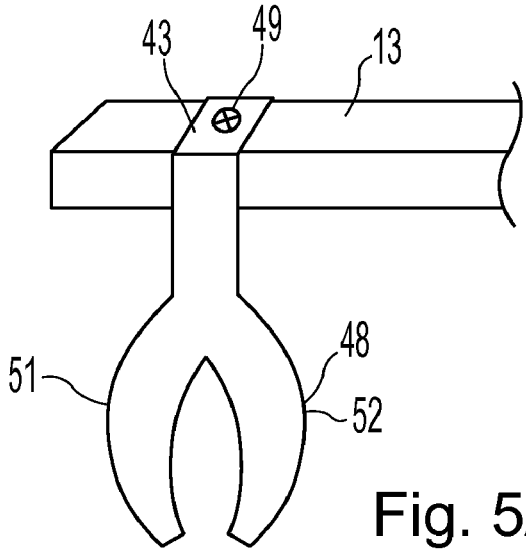
FIGS. 5A-B are perspective views of alternative mounting clips.
Figure 5B:
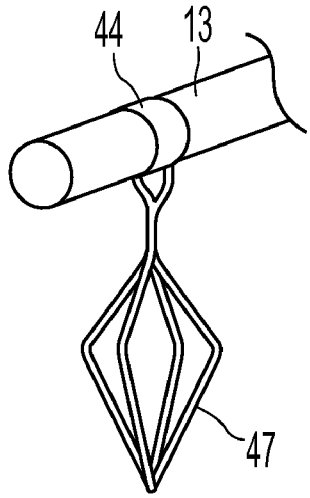

Other configurations of the attachment portion 41 of the mounting clip 40 are contemplated for use with the electrically conductive attachment system. For example, the attachment portion 41 may comprise a clamp 44 extending around a cross-bar 13, as shown in FIG. 5B. The clamp 44 may be tightened around the cross bar 13 to secure the mounting clip to the cross-bar and establish an electrical connection. In another example, the attachment portion 41 may comprise a tab 43, as shown in FIG. 5A. The tab 43 may be attached to a cross-bar 13 by use of a screw 49 similar mechanical attachment. In these examples, the attachment portion 41 may or may not also be welded to the cross-bar 13 as desired for a specific application.

The engagement portion 45 of the mounting clip 40 may be adapted to be inserted through the top opening 33 of the tubular portion 30 engaging the inner surface 35 of the tubular portion and providing an electrical connection between the tubular portion and the mounting clip. The engagement portion 45 may be formed from various materials and in various configurations. The engagement portion 45 is electrically connected to the attachment portion 41 previously discussed and may be formed from the same material as the attachment portion. Alternatively, the engagement portion 45 and the attachment portion 41 may be formed from separate materials and then connected to form the mounting clip 40. In one example, the engagement portion 45 and the attachment portion 41 are both formed from a section of resilient wire.

Referring to FIG. 2A, one example of an engagement portion 45 is illustrated. In this example, the engagement portion 45 may be resilient wire forming a substantially J-shaped hook adapted to resiliently engage the inner surface 35 of the tubular portion 30. The J-shaped hook may comprise a first contact portion 51 extending from the attachment portion 41 and away from the cross-bar 13 towards the lower portion 53 of the hook, and a second contact portion 52 extending generally upwards from the lower portion 53 towards the cross-bar. It will be apparent that the lower portion 53 may be either rounded as illustrated or angled. Additionally, additional wire-form shapes are contemplated for use with the presently described system, such as U-shape, V-shape, or O-shape, without departing from the scope of the present disclosure.

Figure 2B:
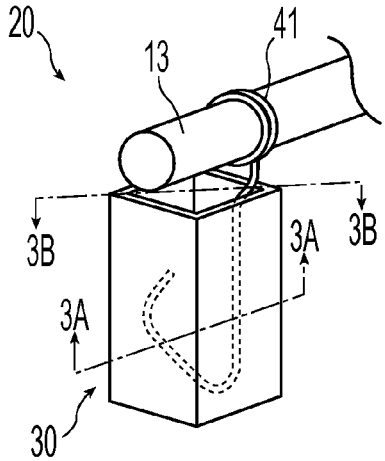

The engagement portion 45 may be inserted through the top opening 33 of the tubular portion 30 as illustrated in FIG. 2B. When the engagement portion 45 is inserted, the cross-bar 13 may rest on walls of the tubular portion 30 substantially across the top opening 33. The tubular portions 30 attached to the support beams 12 may thereby bear the weight of the cross-bar 13 and the articles 16 to be coated.

Figure 3B:
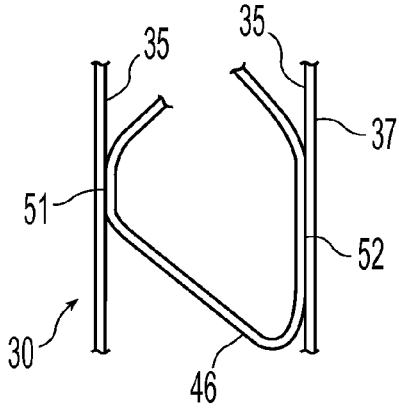

Also when the engagement portion 45 is inserted, the first contact portion 51 and the second contact portion 52 of the engagement portion engage the inner surface 35 of the tubular portion 30 and provide an electrical connection between the tubular portion and the mounting clip 40. As illustrated in FIG. 3B, a cross-section view is shown of a J-shaped engagement portion 46 inserted into a tubular portion 30. The inner surface 35 and the outer surface 37 of the walls of the tubular portion 30 are illustrated. As shown, the first contact portion 51 and the second contact portion 52 of the J-shaped engagement portion 46 are contacting the inner surface 35 of the tubular portion 30. It will be understood that the first contact portion 51 and the second contact portion 52 refer generally to the portions of the engagement portion that contact the inner surface 35 of the tubular portion 30 when the engagement portion is inserted into the tubular portion. Accordingly, the first contact portion 51 and the second contact portion 52 may be any portion of the engagement portion that contact the inner surface 35 of the tubular portion 30 and may be substantially straight, curved or angled portions of the engagement portion.

Referring to FIG. 3A, a different cross section is shown of the J-shaped engagement portion 46 inserted into a tubular portion 30. As illustrated in FIG. 3A, the tubular portion 30 may be substantially rectangular having corners 32. The engagement portion may engage the inner surface 35 of the tubular portion 30 substantially adjacent two of the corners of the tubular portion. For example, the first contact portion 51 of a J-shaped engagement portion 46 may engage one corner, while the second contact portion 52 of the J-shaped engagement portion engages an opposite corner. In some embodiments it may be desired for the engagement portion to extend between opposite corners of the tubular portion 30 to reduce movement or rotation of the engagement portion within the tubular portion.

The engagement portion 45 may also be adapted to resiliently engage the inner surfaces 35 of the tubular portion 30. Referring to the J-shaped engagement portion 46, the width of the engagement portion measured from the first contact portion 51 to the second contact portion 52 may be slightly larger than the corresponding dimension of the tubular portion. Referring to FIG. 3A, the corresponding dimension of the tubular portion is the distance between one corner 32 and the opposite corner 32. When the engagement portion is inserted into the tubular portion 30, the engagement portion may be compressed causing the engagement portion to exert force against inner surface 35 of the tubular portion 30. The force exerted may be generally outward and may restrain unintended movement of the engagement portion within the tubular portion 30.

The precise direction of the force exerted will depend upon the shape of the engagement portion and the tubular portion 30. Similarly, the shape or geometry of the engagement portion and the cross-section of the tubular portion may be selected so as to mate generally as described herein. Other examples of engagement portions are contemplate and function substantially as described above. For example, the engagement portion may be formed in a generally inverted U-shape 48 such as illustrated in FIG. 5A. The generally inverted U-shape 48 may also have a first contact portion 51 and a second contact portion 52 that contact the inner surface 35 of a tubular portion 30. The generally inverted U-shape 48 may also be adapted to provide resilient forces against the inner surface 35 of the tubular portion 30. The generally inverted U-shape 48 may be formed from various materials including sheet steel. Additional features may be incorporated to provide rigidity to the shape while maintaining resiliency in between the first contact portion 51 and the second contact portion 52.

Figure 8:
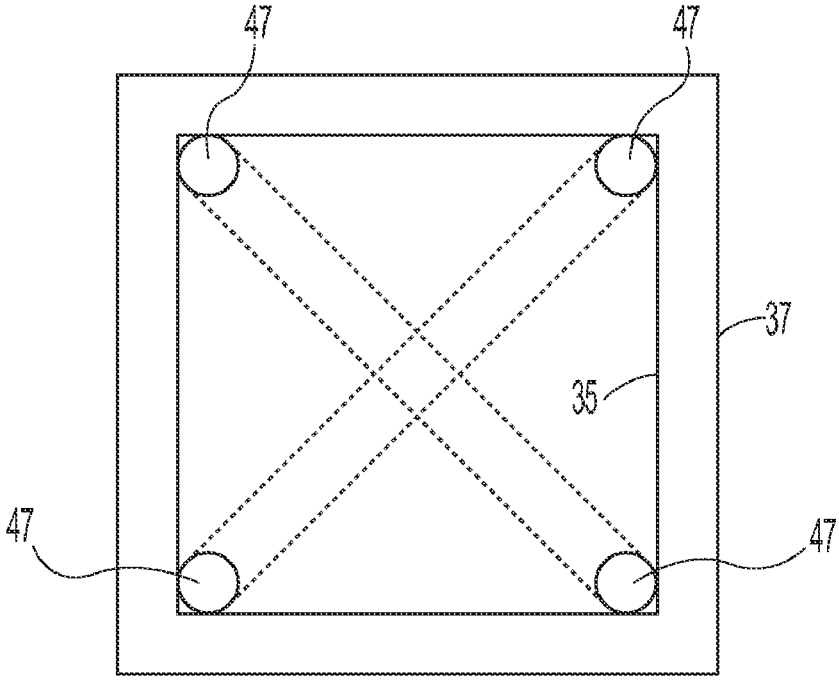
FIG. 8 is a cross-section view of another attachment device.

Another example of an engagement portion is illustrated in FIG. 5B. The engagement portion shown in FIG. 5B may be a wire cage 47. The wire cage 47 may be formed of resilient wire comparable to the J-shaped hook 46 previously discussed. In one example, the engagement portion may be adapted to engage the inner surface 35 of the tubular portion 30 substantially adjacent four corners of the tubular portion such as illustrated in FIG. 8. In this example, a wire cage 47 may have four segments as shown in FIG. 5B. Other configurations with three or more segments are also contemplated. In one example, the engagement portion may have six segments and a tubular portion with a hexagonal cross-section may be employed. It will be apparent from these examples that numerous configurations of mounting clips and tubular portions may be utilized.

The engagement portion 45 may be further adapted to abrade the inner surface 35 of the tubular portion 30 during insertion of the engagement portion into the tubular portion. As previously discussed the engagement portion 45 may exert force against the inner surface 35. This force may cause the engagement portion 45 to scrape or wear off coating material that may collect on the inner surface 35 of the tubular portion 30. The abrasion of the inner surface 35 of the tubular portion 30 may thus improve the electrical contact between the engagement portion 45 and the tubular portion 30 by removing non-conductive coating material or debris when the engagement portion is inserted. This may produce a self-cleaning action whereby the act of reconfiguring the electrically conductive article support rack results in removal of non-conductive material and improve the electrical connectivity of the support rack. This self-cleaning feature may thus improve the usable life of the support rack and reduce the frequency of required cleanings to remove accumulated coating material from the surfaces of the support rack. Additionally, the surface of the engagement portion may be adapted to increase the abrasion of the inner surface to improve the electrical connection between the mounting clip and the tubular portion.

Various configurations of attachment portions and engagement portions have been described above for use with mounting clips in the electrically conductive attachment system. Additional configurations and combinations of those described are also contemplated for use with the disclosed system.

An electrically conductive article support rack having electrically conductive attachment devices may be used in a coating operation. For example, a support rack may be assembled with a hanger portion selected to attach to a conveyor or other device adapted to move the support rack through the coating operation. In various applications, a support rack may be employed to support articles in cleaning, coating, drying, curing, and other stages of a coating operation. These stages may be conducted at separate locations requiring the support rack to be moved between locations. Alternatively, one or more stages may be conducted sequentially in a given location. The coating operation may include spray coating, dip coating, or other coating techniques. The coating may comprise electro-static or electro-deposition coating. Additionally, electroplating of the article may also be possible utilizing the support rack. If used in electroplating operations, a protective coating, such as vinyl, polyethylene or a polyvinylchloride, may be applied to the support rack to reduce undesired plating of the support rack components.

The support rack may be sized for the number and type of articles to be coated. The hanger portion of the support rack may be selected to position the support rack at a proper vertical location for the coating operation. The hanger portion may also be selected of an appropriate material to bear the weight of the support rack and articles. The length of the support beams, or vertical support beams, may be chosen to accommodate the one or more cross-bars as desired for a specific application. The width of the support rack and of the upper support member may also be selected with respect to the quantity and size of articles to be supported by the rack. The hanger portion, support beams, and upper support member may be connected in a variety of fashions, including welding and mechanical attachments such as screws or bolts. The attachment method may be selected based upon the weight of the specific rack and articles to be coated.

The support rack may be configured or reconfigured to accommodate different size articles to be coated. For example, tubular portions 30 of the attachment device may be attached to the support beams 12 at a variety of locations along the length of the support beams. In one example, tubular portions 30 may be positioned every 6 inches along the support beams to provide multiple positions for the attachment of crossbars 13. During operation, some tubular portions 30 may be unused. The unused tubular portions may have a plug inserted or a cover applied to reduce the ingress of coating material into the unused tubular portions. One or more cross-bars 13 may be attached to the support beams 12 to support the articles 16 to be coated. The cross-bars 13 may be spaced sufficiently apart so that the articles 16 do not contact a cross-bar 13 attached below the article. To maximize the productivity of the rack, the cross-bars 13 may be positioned to provide minimum clearance between the articles 16 and the cross-bars 13 to maximize the number of articles 16 that may be coated in a single operation. Additionally, the cross-bars 13 may be positioned at varying distances along the support beams to accommodate differently sized articles 16 in a single coating operation.

The cross-bars 13 may be attached to the support beams 12 by inserting the engagement portions 45 of the mounting clips 40 into a pair of tubular portions 30 attached to the support beams 12. Upon insertion, the engagement portions 45 engage the inner surface 35 of the tubular portion 30 establishing an electrical connection. After an initial cycle of the coating operation, coating material may adhere to the inner surface 35 of the tubular portion 30. The resilient force of the engagement portion 45 exerted against the inner surface 35 of the tubular portion 30 may abrade the inner surface removing undesired coating material and permitting an electrical connection to be established.

Once attached, the cross-bar 13 may rest on the walls of the tubular portion, as illustrated in FIG. 2B. The cross-bar bar 13 may partially or completely cover the top opening 33 of the tubular portion 30. In spray coating operations, the cross-bar 13 may sufficiently cover the top opening 33 of the tubular portion 30 to reduce the ingress of coating material into the tubular portion 30. The tubular portion 30 may also bear the weight of the cross-bar 13 and the articles 16 to be coated reducing wear on the mounting clip and improving the useful life of the system.

The cross-bars 13 may be removed or reconfigured by lifting or pulling the cross-bar in a generally upward direction to disengage the engagement portion 45 from the tubular portion 30. The resilient force of the engagement portion 45 exerted against the inner surface 35 of the tubular portion 30 may also abrade the inner surface removing undesired coating material when the cross-bar is removed. This abrading of the inner surface 35 by the engagement portion 45 may be described as a self-cleaning action whereby the electrical connectivity of the support rack is improved or maintained as the support rack is reconfigured. This self-cleaning action may extend the useful life of the support rack and reduce the frequency with which the support rack must be stripped or cleaned of excess coating material. By reducing the frequency of required cleanings, the productivity of a coating operation may be increased and the cost of maintaining the support rack may be reduced.

The mounting clip 40 may be removed from the cross-bar and replaced. Over time, as the cross-bars 13 of the support rack 10 are reconfigured, the mounting clip 40 may become damaged. Additionally, the weight of articles 16 may over time cause the cross-bar 13 to deform such that replacing the cross-bar 13 is desired. The electrically conductive attachment device may facilitate maintenance of the system. If a mounting clip 20 were to become damaged, the mounting clip may be removed from the cross-bar 13 and replaced. Similarly, some configurations of tubular portions 30 may also be removed or replaced, such as those attached with clamps or screws. In this fashion, components of the attachment device may be individually repaired or replaced extending the useful life of the support rack 10 and reducing overall maintenance costs.

In another embodiment, an electrically conductive article support rack may comprise a hanger portion, two vertical support beams electrically connected to the hanger portion adapted to support at least one cross-bar transverse the vertical support beams, where the at least one cross-bar is adapted to support articles in electrical connection with the support rack, and the cross-bar being attached to the vertical support beams by attachment devices. The attachment devices each comprising a tubular portion of electrically conductive material adapted to be attached to a vertical support beam having a top opening and a bottom opening, an inner surface extending substantially between the top opening and the bottom opening, and a non-circular cross section including at least two corners; and a mounting clip adapted to be attached to a cross-bar and to releaseably engage the tubular portion having a torsion spring attaching the mounting clip to a cross-bar, and a wire-form engagement spring adapted to be inserted through the top opening of the tubular portion resiliently engaging the tubular portion substantially adjacent two corners of the tubular portion and providing an electrical connection between the mounting clip and the tubular portion; and the attachment device being capable of releaseably connecting the cross-bar substantially transverse to the vertical support beams and capable of providing an electrical connection therebetween. In one example, the tubular portion may comprise steel square tube. Additionally, the cross-bar may comprise stainless steel rod and may be approximately 5 feet in length.

Figure 6:
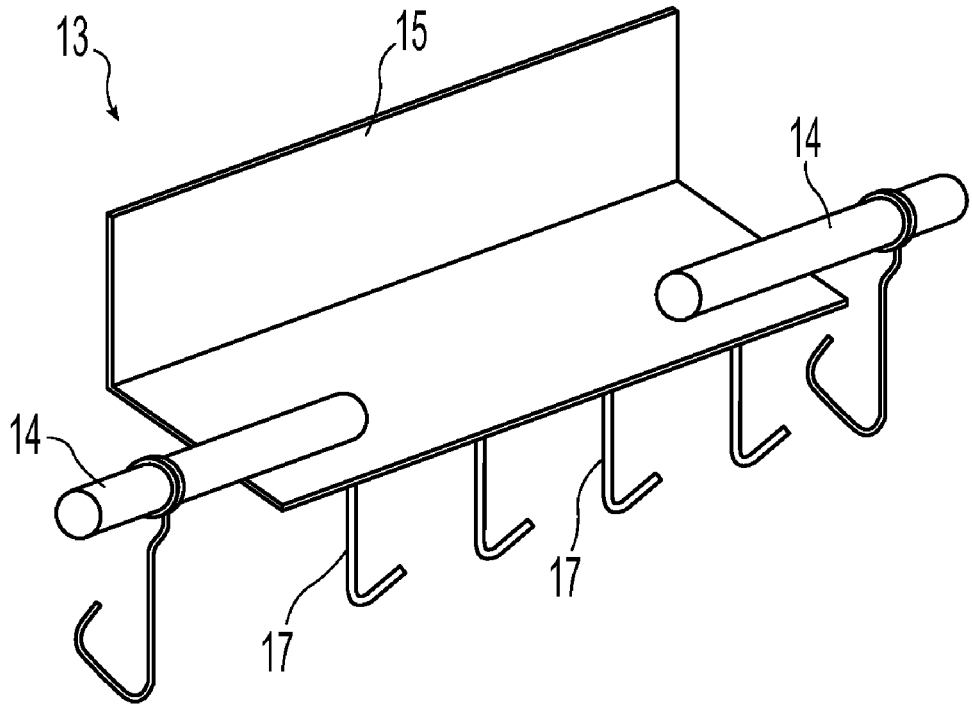
FIG. 6 is a perspective view of an alternative cross-bar.

Referring to FIG. 6, an alternative cross-bar is illustrated for use with the electrically conductive article support rack. The cross-bar 13 comprises end portions 14 connected to opposite ends of a center portion 15, where the end portions 14 are adapted to receive the torsion spring 42 of the mounting clip. The end portions 14 may comprise stainless steel rod, and the center portion 15 may comprise a length of angle bar. The center portion 15 of angle bar may allow the cross-bar 13 to span greater distances between vertical support beams. Additionally, the use of a center portion 15 formed from angle bar or other structural shapes may allow the cross-bar 13 to support articles of greater weight without bending. In one example, article support hooks 17 may be welded to the angle bar to support articles to be coated.

While certain embodiments have been described, it must be understood that various changes may be made and equivalents may be substituted without departing from the sprit or scope. In addition, many modifications may be made to adapt a particular situation or material to the teachings of the disclosure without departing from its spirit or scope.

What is claimed is:

1. An electrically conductive attachment system comprising:

(a) a tubular portion of electrically conductive material adapted to be attached to a support beam having:
  (i) a top opening and a bottom opening; and
  (ii) an inner surface that extends substantially between the top opening and the bottom opening; and (b) a mounting clip adapted to be attached to a cross-bar and to releaseably engage the tubular portion having:
  (i) an attachment portion adapted to electrically connect the mounting clip to the cross-bar; and
  (ii) an engagement portion adapted to be inserted through the top opening of the tubular portion to engage the inner surface of the tubular portion and adapted to provide an electrical connection between the tubular portion and the mounting clip; and (c) the attachment system adapted to releaseably connect the cross-bar substantially transverse the support beam and adapted to provide providing an electrical connection between the cross-bar and the support-beam.

2. The electrically conductive attachment system of claim 1, the tubular portion having a substantially circular cross section.

3. The electrically conductive attachment system of claim 1, the tubular portion having a substantially rectangular cross section.

4. The electrically conductive attachment system of claim 1, the tubular portion having a non-circular cross section including at least two corners.

5. The electrically conductive attachment system of claim 4, the engagement portion adapted to engage the inner surface of the tubular portion substantially adjacent at least two corners of the tubular portion.

6. The electrically conductive attachment system of claim 4, the engagement portion adapted to engage the inner surface of the tubular portion substantially adjacent four corners of the tubular portion.

7. The electrically conductive attachment system of claim 4, the tubular portion comprising steel square tube.

8. The electrically conductive attachment system of claim 1, the attachment portion of the mounting clip comprising a torsion spring.

9. The electrically conductive attachment system of claim 1, the mounting clip comprising a resilient wire.

10. The electrically conductive attachment system of claim 9, the attachment portion of the mounting clip comprising the resilient wire adapted to extend around the cross-bar.

11. The electrically conductive attachment system of claim 9, the engagement portion of the mounting clip comprising the resilient wire configured to form a substantially J-shaped hook adapted to resiliently engage the inner surface of the tubular portion.

12. The electrically conductive attachment system of claim 1, the engagement portion further adapted to abrade the inner surface of the tubular portion during insertion of the engagement portion into the tubular portion.

13. An electrically conductive article support rack comprising:

(a) a hanger portion;

(b) two support beams electrically connected to the hanger portion adapted to support at least one cross-bar transverse the support beams, (c) the at least one cross-bar adapted to support articles in electrical connection with the support rack, the cross-bar adapted to be attached to the support beams by attachment devices, (d) the attachment devices each comprising:
  (1) a tubular portion of electrically conductive material adapted to be attached to a support beam having:
    (i) a top opening and a bottom opening; and
    (ii) an inner surface that extends substantially between the top opening and the bottom opening; and
  (2) a mounting clip adapted to be attached to one of the cross-bars and to releaseably engage the tubular portion having:
    (i) an attachment portion adapted to electrically connect the mounting clip to the cross-bar; and
    (ii) an engagement portion adapted to be inserted through the top opening of the tubular portion to engage the inner surface of the tubular portion and adapted to provide an electrical connection between the tubular portion and the mounting clip; and
  (3) the attachment devices adapted to releaseably connect the cross-bar substantially transverse the support beams and adapted to provide an electrical connection between the cross-bar and at least one of the support beams.

14. The electrically conductive article support rack of claim 13, the tubular portion having a non-circular cross section including at least two corners.

15. The electrically conductive article support rack of claim 14, the engagement portion adapted to engage the inner surface of the tubular portion substantially adjacent at least two corners of the tubular portion.

16. The electrically conductive article support rack of claim 13, the mounting clip comprising a resilient wire.

17. The electrically conductive attachment system of claim 16, the engagement portion of the mounting clip comprising the resilient wire configured to form a substantially J-shaped hook adapted to resiliently engage the inner surface of the tubular portion.

18. An electrically conductive article support rack comprising:

(a) a hanger portion;

(b) two vertical support beams electrically connected to the hanger portion adapted to support at least one cross-bar transverse the vertical support beams, (c) the at least one cross-bar adapted to support articles in electrical connection with the support rack, the cross-bar adapted to be attached to the vertical support beams by attachment devices, (d) the attachment devices each comprising:

(1) a tubular portion of electrically conductive material adapted to be attached to a support beam having:

(i) a top opening and a bottom opening;

(ii) an inner surface that extends substantially between the top opening and the bottom opening; and (iii) a non-circular cross section including at least two corners; and (2) a mounting clip adapted to be attached to a cross-bar and to releaseably engage the tubular portion having:

(i) a torsion spring adapted to attach the mounting clip to one of the cross-bars; and (ii) a wire-form engagement spring adapted to be inserted through the top opening of the tubular portion adapted to resiliently engage the tubular portion substantially adjacent opposite corners of the tubular portion and adapted to provide an electrical connection between the mounting clip and the tubular portion; and (3) the attachment device adapted to releaseably connect the cross-bar substantially transverse to the vertical support beams and adapted to provide an electrical connection between the cross-bar and at least one of the support beams.

19. The electrically conductive article support rack of claim 18, the cross-bar comprising end portions connected to opposite ends of a center portion, where the end portions are adapted to receive the torsion spring of the mounting clip.

20. The electrically conductive article support rack of claim 19, the end portions of the cross-bar comprising stainless steel rod.

* * * * *

UNITED STATES PATENT AND TRADEMARK OFFICE

CERTIFICATE OF CORRECTION

PATENT NO. : 8,215,502 B1
APPLICATION NO. : 12/567121
DATED : July 10, 2012
INVENTOR(S) : Tom Beavers It is certified that error appears in the above-identified patent and that said Letters Patent is hereby corrected as shown below:

IN THE SPECIFICATION:

Column 4, line 20, “clips; and” should read --clips;--.
Column 11, line 53, “provide providing” should read --provide--.

Signed and Sealed this
Eleventh Day of September, 2012

David J. Kappos

David J. Kappos
*Director of the United States Patent and Trademark Office*